US009733014B2

(12) United States Patent
Schwenk et al.

(10) Patent No.: US 9,733,014 B2
(45) Date of Patent: Aug. 15, 2017

(54) METHOD AND DEVICE FOR OBTAINING COMPRESSED OXYGEN AND COMPRESSED NITROGEN BY THE LOW-TEMPERATURE SEPARATION OF AIR

(75) Inventors: Dirk Schwenk, Aschheim (DE); Alexander Alekseev, Wolfratshausen (DE); Frances Masterson, Munich (DE); Dimitri Goloubev, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 1193 days.

(21) Appl. No.: 13/816,809

(22) PCT Filed: Aug. 9, 2011

(86) PCT No.: PCT/EP2011/003982

§ 371 (c)(1), (2), (4) Date: Apr. 22, 2013

(87) PCT Pub. No.: WO2012/019753

PCT Pub. Date: Feb. 16, 2012

(65) Prior Publication Data

US 2013/0205831 A1 Aug. 15, 2013

(30) Foreign Application Priority Data

Aug. 13, 2010 (EP) ..... 10008479
Aug. 13, 2010 (EP) ..... 10008480
Dec. 30, 2010 (DE) ..... 10 2010 056 560

(51) Int. Cl.
*F25J 3/06* (2006.01)
*F25J 3/04* (2006.01)

(52) U.S. Cl.
CPC ..... *F25J 3/04018* (2013.01); *F25J 3/0409* (2013.01); *F25J 3/04084* (2013.01);
(Continued)

(58) Field of Classification Search
CPC ..... F25J 3/0403; F25J 3/0406; F25J 3/04109; F25J 3/04193; F25J 3/042; F25J 3/0428;
(Continued)

(56) References Cited

U.S. PATENT DOCUMENTS 4,548,618 A * 10/1985 Linde ..... B01D 53/00 62/624
4,843,828 A 7/1989 Gladman
(Continued)

FOREIGN PATENT DOCUMENTS

DE 4030750 A1 * 4/1992 ..... F25J 3/04018
EP 0042676 A1 12/1981
(Continued)

OTHER PUBLICATIONS

DE 4030750 Translation.*
(Continued)

*Primary Examiner* — Frantz Jules
*Assistant Examiner* — Brian King
(74) *Attorney, Agent, or Firm* — Millen, White, Zelano, Branigan, P.C.

(57) ABSTRACT

The invention relates to a method and device for obtaining compressed oxygen and compressed nitrogen by the low-temperature separation of air in a distillation column system for nitrogen-oxygen separation, said distillation column system having at least one high-pressure column (8) and one low-pressure column (460), wherein the low-pressure column (460) is in a heat-exchanging connection with the high-pressure column (8) by means of a main condenser (461) designed as a condenser-evaporator. Feed air is compressed in an air compressor (2). The compressed feed air (6, 734, 802, 840) is cooled down in a main heat exchanger (20) and at least partially introduced into the high-pressure column (8). An oxygen-enriched liquid (462, 465) is removed from the high-pressure column (8) and fed to the low-pressure column (460) at a first intermediate position (464, 467, 906). A nitrogen-enriched liquid (468, 470) is removed from the high-pressure column (8) and/or the main condenser (461) and fed to the head of the low-pressure column (460). A liquid oxygen flow (11, 12) is removed from the distillation column system for nitrogen-oxygen separation, brought to an elevated pressure in the liquid state (13), introduced into the main heat exchanger (20) at said
(Continued)

Figure 1:
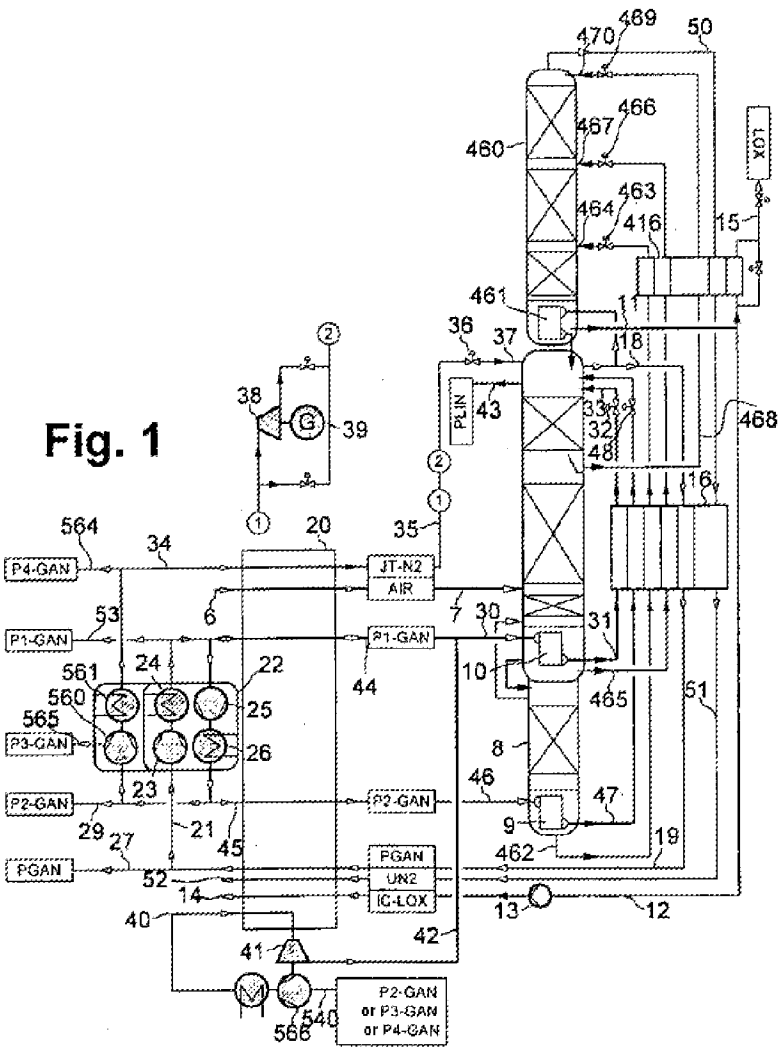

elevated pressure, evaporated or pseudo-evaporated and heated to approximately ambient temperature in the main heat exchanger (20), and finally obtained as a gaseous compressed oxygen product (14). A high-pressure process flow (34, 734) is brought into indirect heat exchange with the oxygen flow in the main heat exchanger (20) and then depressurized (36, 38; 736, 738), wherein the depressurized high-pressure flow (37, 737) is introduced at least partially in the liquid state into the distillation column system for nitrogen-oxygen separation. A gaseous circuit nitrogen flow (18, 19) is drawn from the high-pressure column and at least partially (21) compressed in a circuit compressor (22). A first sub-flow (45, 46; 244, 242, 230; 845, 846) of the circuit nitrogen flow is removed from the circuit compressor (22, 322), cooled down in the main heat exchanger (20), at least partially condensed in the bottom evaporator (9, 209) of the high-pressure column (8) in indirect heat exchange with the bottom liquid of the high-pressure column (8), and conducted back into the distillation column system for nitrogen-oxygen separation. A second sub-flow of the circuit nitrogen flow is branched off upstream and/or downstream of the circuit compressor and/or from an intermediate stage of the circuit compressor at a product pressure (P, P1, P2, P3, P4) and obtained as a compressed nitrogen product (27, 29, 53, 564, 565). The circuit compressor (22, 322) is designed as a hot compressor and is driven by means of external energy.

17 Claims, 9 Drawing Sheets

(52) U.S. Cl.
CPC ..... *F25J 3/04175* (2013.01); *F25J 3/04296* (2013.01); *F25J 3/04351* (2013.01); *F25J 3/04357* (2013.01); *F25J 3/04387* (2013.01); *F25J 3/04406* (2013.01); *F25J 3/04412* (2013.01); *F25J 3/04448* (2013.01); *F25J 3/04812* (2013.01); *F25J 3/04884* (2013.01); *F25J 3/04933* (2013.01); *F25J 2200/52* (2013.01); *F25J 2240/10* (2013.01); *F25J 2240/12* (2013.01); *F25J 2240/44* (2013.01)

(58) Field of Classification Search
CPC .. F25J 3/04284; F25J 3/04309; F25J 3/04315; F25J 2215/42; F25J 2230/32; F25J 2230/42; F25J 2240/02; F25J 2240/12; F25J 2245/42; F25J 2250/42
See application file for complete search history.

(56) References Cited

U.S. PATENT DOCUMENTS

| | | | | |
|---|---|---|---|---|
| 5,163,296 | A | 11/1992 | Ziemer et al. | |
| 5,412,953 | A | 5/1995 | Darredeau et al. | |
| 6,141,989 | A * | 11/2000 | Oakey | F25J 3/04084 62/647 |
| 2009/0320520 | A1 * | 12/2009 | Parsnick | F25J 3/04224 62/648 |

FOREIGN PATENT DOCUMENTS

| | | | |
|---|---|---|---|
| EP | 0618415 | A1 | 10/1994 |
| EP | 1750074 | A1 | 2/2007 |
| JP | 11-118352 | A | 4/1999 |

OTHER PUBLICATIONS

International Search Report for PCT/EP2011/003982 (Nov. 9, 2012).
International Preliminary Report on Patentability for PCT/EP2011/003982 (Feb. 19, 2013).
English Translation of JP 11-118352A.

* cited by examiner

METHOD AND DEVICE FOR OBTAINING COMPRESSED OXYGEN AND COMPRESSED NITROGEN BY THE LOW-TEMPERATURE SEPARATION OF AIR

The invention relates to a method of obtaining compressed oxygen and compressed nitrogen by low-temperature separation of air in which a circulation compressor is configured as a warm compressor and is driven by means of external energy.

The distillation-column system for nitrogen-oxygen separation can be constructed in the invention as a two-column system (for example as a classical Linde double column system), or also as a three-column or multicolumn system. In addition to the columns for nitrogen-oxygen separation, further devices can be provided for obtaining high-purity products and/or other components from the air, especially inert gases, for example argon production and/or krypton-xenon production.

The principles of low-temperature separation of air in general and the construction of double column installations in particular are described in the monograph "Tieftemperaturtechnik" [low-temperature technology] by Hausen/Linde (2nd edition, 1985) and in an essay by Latimer in Chemical Engineering Progress (Vol. 63, No. 2, 1967, page 35). The heat exchange relationship between high-pressure column and low-pressure column of a double column is as a rule achieved with a main condenser, in which the overhead gas of the high-pressure column is liquefied against evaporating bottom liquid of the low-pressure column.

"High-pressure column" means in this context a column that is operated at above-atmospheric operating pressure of at least 4 bar, as a rule between about 4 and 6 bar, sometimes at even higher pressure. The "low-pressure column" has a lower operating pressure and is connected with heat exchange to the high-pressure column via a common condenser-evaporator.

The "main heat exchanger" serves for cooling the feed air and can be formed from a single heat exchanger unit or also from a plurality of heat exchanger units.

The invention relates to a method of producing gaseous compressed oxygen, in which the pressure increase takes place in the liquid product and the high-pressure liquid is then evaporated (or—at supercritical pressure—pseudo-evaporated) in indirect heat exchange with a high-pressure process stream (heat carrier). This type of method is often called "internal condensing" and is described for example in Hausen/Linde, Tieftemperaturtechnik, 2nd edition 1985, p. 319-322. Nitrogen or feed air can be used as the high-pressure process stream. The product pressure in internal condensing is for example 6 to 100 bar, preferably 30 to 95 bar. The upper circulation pressure of the nitrogen circuit is for example between 20 and 90 bar, preferably between 20 and 75 bar.

A method of the type stated at the beginning is known from JP 11118352A.

The problem to be solved by the invention is to provide a method of the type stated at the beginning and a corresponding device, which are particularly favorable economically and in particular have an especially low energy consumption at reasonable cost of the apparatus.

This problem is solved by the use of a circulation compressor that is configured as a warm compressor and is driven by means of external energy. Thus, the circulation compressor is designed as a warm compressor, i.e. it is operated with an inlet temperature that is above 250 K, especially above 270 K. In addition it is driven by means of external energy, for example with an electric motor or a steam turbine, but not with a turbine that expands a process stream of the air separation. Contrary to the main idea of JP 11118352 A, the circulation compressor is not operated as a cold compressor and moreover is not driven by a turbine, in which the circulation nitrogen stream is expanded.

As a result, the circulation nitrogen stream can be set independently of the cold requirement of the plant. In particular, the heating power in the bottom evaporator of the high-pressure column can be freely selected. In this way the method can be adapted far more flexibly to present requirements and so can be operated energetically more favorably.

In the method according to the invention, the high-pressure column is operated with an operating pressure (at the top) of for example 5 to 6.5 bar, preferably 5.2 to 6.2 bar. In the case when a two-column or multicolumn system is used as the distillation-column system for nitrogen-oxygen separation, the low-pressure-column pressure is less than 2 bar, preferably less than 1.6 bar.

The "gaseous circulation nitrogen stream" from the distillation-column system for nitrogen-oxygen separation to the circulation compressor is preferably withdrawn from the top of the high-pressure column.

The product pressure of the compressed nitrogen product can be equal to, lower or higher than the pressure at which the first partial stream is withdrawn from the circulation compressor, it is for example at the level of the operating pressure of the high-pressure column or higher. The compressed nitrogen product can be delivered in a plurality of substreams at different pressures; in this case the whole of the compressed nitrogen product is designated here as "second partial stream".

In the context of a variant of the invention, the amount of steam ascending in the bottom section of the low-pressure column can be adjusted with the setting of the amount of the second partial stream of the circulation nitrogen stream and the amount of the return liquid in the upper part of the low-pressure column indirectly via the setting of the amount of the first partial stream of the circulation nitrogen stream, i.e. the heating power of the high-pressure column bottom evaporator. In this way the reflux ratio can be optimized both in the upper and in the lower part of the low-pressure column.

If the amount of the first partial stream of the circulation stream is increased or reduced and in consequence more or less nitrogen is condensed in the bottom evaporator, a correspondingly altered amount of liquid nitrogen is available as return liquid in the high-pressure column and more or less high-pressure nitrogen can be taken; it is immaterial whether a part of the liquid nitrogen is fed from the bottom evaporator directly into the low-pressure column, or whether it is fed into the high-pressure column and therefore correspondingly more (or less) liquid nitrogen can be transferred from the high-pressure column or from the main condenser into the low-pressure column. If less or more high-pressure-column nitrogen is taken as "second partial stream" and therefore more or less heating power is available at the main condenser, correspondingly more or less ascending steam is produced for the lower part of the low-pressure column.

The method is suitable in particular for obtaining impure compressed oxygen with a purity of less than 98 mol %, preferably of 97% or less. It can be used especially advantageously for IGCC plants, in which at least one part of the compressed oxygen product is fed into coal gasification for producing a fuel gas and at least one part of the compressed nitrogen product is used for coal transport.

Basically, the method according to the invention can be operated with constant total amount of compressed nitrogen product, wherein the total amount of compressed nitrogen product is formed by the sum of the streams that are branched from the circulation nitrogen stream upstream and/or downstream of the circulation compressor and/or from an intermediate stage of the circulation compressor at a product pressure and are obtained as compressed nitrogen product, i.e. the total amount of nitrogen product that finally comes from the high-pressure column and not from the low-pressure column or some other column. (These and all other amounts stated are to be understood as molar.)

In a preferred configuration, however, the method is carried out with variable load, wherein in a first loading case

- a first total amount of compressed nitrogen product PN1 is obtained,
- the first partial stream is led in a first partial stream amount TS1 through the bottom evaporator of the high-pressure column and
- the feed air is fed in a first amount of feed air EL1 into the air compressor, and wherein in a second loading case

- a second, higher total amount of compressed nitrogen product PN2 is obtained, PN2>PN1,
- the first partial stream is led in a second, higher partial stream amount TS2 through the bottom evaporator of the high-pressure column, TS2>TS1, and
- the feed air is fed in a second amount of feed air EL2 into the air compressor, wherein the second amount of feed air EL2 is equal to the first amount of feed air EL1 or is only insignificantly higher, wherein (EL2−EL1)/EL1<0.2·(PN2−PN1)/PN1.

Despite the increased overall production of compressed nitrogen, the amount of feed air thus remains the same or is only insignificantly increased. "Insignificantly" means here that the relative change in the amount of air is at most a fifth, preferably less than a tenth of the relative change in the amount of compressed nitrogen product. If, in a concrete example, the total amount of compressed nitrogen product PN2 in the second loading case is 50% higher than in the first, the second amount of feed air EL2 is increased by less than 10%, and preferably it remains the same. With the amount of air remaining the same or only slightly increased, it is thus possible to achieve a substantial increase in the overall production of compressed nitrogen. In addition, with the amount of air remaining essentially the same, there is relatively little disturbance of the separation process within the distillation-column system when there is a change in load, and therefore the product purity remains largely constant. In addition, the amount of gaseous compressed oxygen product may remain the same or only change insignificantly.

In a concrete example, a second partial stream is extracted downstream of the circulation compressor as a single compressed nitrogen product. With increase in load from a first to a second loading case, the total amount of compressed nitrogen product (i.e. in this case the amount of the second partial stream) is increased by 25% (PN2=1.25 PN1). Simultaneously, the amount of the heating stream of the high-pressure column bottom evaporator is increased by approx. 45% (TS2=1.45 TS1), but the amount of feed air remains unchanged. The change in the first partial stream is related linearly to the change in compressed nitrogen product.

Increasing the extraction of compressed nitrogen with the amount of feed air remaining the same results in an almost unchanged oxygen content in the impure nitrogen product of the low-pressure column (UN2). The amount of the internally compressed product oxygen remains constant. With increase in the extraction of compressed nitrogen, the UN2 amount becomes smaller, which at the same time determines the amount of ascending gas in the low-pressure column. If the extraction of compressed nitrogen is increased by 10 000 $Nm^3/h$, the UN2 amount also decreases by 10 000 $Nm^3/h$. The load on the main condenser is thus directly proportional to the extraction of compressed nitrogen. If for example 10 000 $Nm^3/h$ more is taken, 10 000 $Nm^3/h$ less nitrogen is liquefied at the main condenser. The wash-LIN liquid for the low-pressure column also becomes correspondingly less (by approx. 0.4*10 000=4000 $Nm^3/h$). This means the reflux ratio in the upper section of the low-pressure column remains almost unchanged. The wash-LIN liquid for the pressure column (from the main condenser) is then reduced by approx. 0.6*10 000=6000 $Nm^3/h$. However, so as not to lose the product purities, the reflux ratio in the pressure column must be "restored". This is now ensured by a corresponding increase of the first partial stream.

The first partial stream can be controlled by means of an AIC controller (for example keeping the oxygen product purity constant).

It is moreover advantageous if a third partial stream of the circulation nitrogen stream is taken as turbine stream from the circulation compressor, expanded with performance of work and is fed at least partially into the distillation-column system for nitrogen-oxygen separation. The energy produced in the expansion of the turbine stream, performing work, is preferably transmitted mechanically to an after-compressor, in which for example the turbine stream upstream of the work-performing expansion and/or the first partial stream of the circulation nitrogen stream upstream of its introduction into the main heat exchanger are re-compressed.

Alternatively, process cold can be obtained by work-performing expansion of a partial stream of the feed air. The mechanical energy obtained is preferably transferred to an after-compressor for the turbine air.

It is advantageous if, in the method according to the invention, a liquid fraction from the high-pressure column at the operating pressure of the high-pressure column is fed into a condenser-evaporator and is at least partially evaporated there in indirect heat exchange with at least one part of the work-performing expanded turbine stream, wherein the steam produced is returned at least partially into the high-pressure column. Boiling the high-pressure column improves its separation effect. The heating agent used in the context of the invention is not a stream that is specially to be compressed, but the turbine stream that is present anyway at a suitable pressure level. The circulation compressor is therefore used for another purpose, the thorough heating of the high-pressure column.

The "condenser-evaporator", in which a liquid fraction from the high-pressure column is boiled up, is constructed as a heat exchanger separate from the main heat exchanger, especially as at least one plate-type heat exchanger unit, most preferably as a single plate-type heat exchanger unit; it can be arranged inside the high-pressure column or also outside in a separate vessel.

The liquid fraction to the condenser-evaporator can be taken from the bottom of the high-pressure column—the condenser-evaporator then represents the bottom evaporator and is preferably arranged directly in the bottom of the high-pressure column. Alternatively the condenser-evaporator is designed as intermediate evaporator of the high-pressure column and for example at an intermediate level inside the high-pressure column; the liquid fraction for the condenser-evaporator is then withdrawn at the corresponding intermediate point of the high-pressure column. In this case the bottom evaporator and the intermediate evaporator are heated by different partial streams of the circulation nitrogen stream, which are extracted at different suitable pressures from the circulation compressor.

Often the pressure of the first partial stream of the circulation nitrogen stream is the highest pressure required in the process. If there is a particularly high cold requirement, the third partial stream of the circulation nitrogen stream (turbine stream) can also be withdrawn at this pressure level from the circulation compressor. In many cases, however, it is favorable to withdraw the third partial stream of the circulation nitrogen stream at an upper intermediate pressure (P3, P4) from an intermediate stage of the circulation compressor and then supply it for work-performing expansion. The inlet pressure of the work-performing expansion is then roughly at the level of the upper intermediate pressure, but can optionally be increased by an after-compressor coupled to the expander.

The first partial stream of the circulation nitrogen stream can be withdrawn at a high pressure (P4) from the circulation compressor, which is higher than the intermediate pressure (P3) at which the third partial stream of the circulation nitrogen stream is taken from the circulation compressor; then the first partial stream is fed at this high pressure or at an even higher pressure into the main heat exchanger. In this way, on the one hand an especially high product pressure can be achieved for the gaseous compressed oxygen product, and on the other hand this pressure level is decoupled from the inlet pressure of the work-performing expansion, which can be lower. Furthermore, a part of the circulation nitrogen stream can also be obtained at the high pressure as compressed nitrogen product, without requiring additional expenditure on equipment.

In a first operating mode, a fourth partial stream of the circulation nitrogen stream is withdrawn at a lower intermediate pressure (P2) from an intermediate stage of the circulation compressor, cooled in an intermediate-pressure passage of the main heat exchanger and mixed with the work-performing expanded turbine stream upstream of the condenser-evaporator. This is especially favorable when the turbine stream is used for thorough heating of the high-pressure column in the first condenser-evaporator. If relatively little cold is required, the turbine stream can be so small that on its own it can no longer supply the heat required for the column heating. Through the admixture of the fourth partial stream, additional heat can be brought into the condenser-evaporator. Production of cold and column operation are therefore independent. The cold power that is provided by the turbine stream can vary over a wide range, without affecting the operation of the distillation-column system.

Conversely, in a second operating mode a part of the work-performing expanded turbine stream in the intermediate-pressure passage of the main heat exchanger can be warmed and supplied to the circulation compressor in an intermediate stage. This is mainly advantageous when a large amount of cold is produced and the turbine stream is therefore too great for heating the first condenser-evaporator. For this recycling and for conveying the fourth partial stream in the first operating mode, a reciprocating line will preferably, which leads through the same passages of the main heat exchanger ("intermediate passage").

The liquid oxygen stream for the internal condensing will preferably be taken from the lower region of the low-pressure column.

In addition, an intermediate liquid, with oxygen content between that of the oxygen-enriched liquid and that of the nitrogen-enriched liquid, can be taken from the high-pressure column and can be supplied to the low-pressure column at a second intermediate point, which is arranged above the first intermediate point, wherein the intermediate liquid is taken in particular at the level of an intermediate evaporator of the high-pressure column.

The invention further relates to a device for obtaining compressed oxygen and compressed nitrogen by low-temperature separation of air comprising:

- a distillation-column system for nitrogen-oxygen separation, which has at least a high-pressure column and a low-pressure column, wherein the low-pressure column has a main condenser, configured as condenser-evaporator, for heat-exchanging connection of low-pressure column and high-pressure column,
- an air compressor for compressing feed air,
- a main heat exchanger for cooling the compressed feed air,
- means for feeding the cooled feed air into the high-pressure column
- means for withdrawing an oxygen-enriched liquid from the high-pressure column and for supplying this liquid or a liquid derived therefrom to the low-pressure column at a first intermediate point,
- means for withdrawing a nitrogen-enriched liquid from the high-pressure column (8) and/or the main condenser and for delivering this liquid to the top of the low-pressure column,
- means for withdrawing a liquid oxygen stream from the distillation-column system for nitrogen-oxygen separation,
- means for bringing the oxygen stream in the liquid state to an increased pressure, feeding it at this increased pressure into the main heat exchanger, for evaporating or pseudo-evaporating in the main heat exchanger and warming roughly to ambient temperature and finally for withdrawal as gaseous compressed oxygen product,
- means for bringing a high-pressure process stream in the main heat exchanger in indirect heat exchange with the oxygen stream and then expanding it,
- means for feeding the expanded high-pressure process stream at least partially in the liquid state into the distillation-column system for nitrogen-oxygen separation,
- means for withdrawing a gaseous circulation nitrogen stream from the high-pressure column,
- a circulation compressor for compressing at least one part of the circulation nitrogen stream,
- means for withdrawing a first partial stream of the circulation nitrogen stream from the circulation compressor, for cooling the first partial stream in the main heat exchanger, for feeding the first partial stream into the bottom evaporator of the high-pressure column for the purpose of at least partial liquefaction in indirect heat exchange with the bottom liquid of the high-pressure column and for recycling the at least partially liquefied first partial stream to the distillation-column system for nitrogen-oxygen separation, and with
- means for branching off a second partial stream of the circulation nitrogen stream upstream and/or downstream of the circulation compressor and/or from an intermediate stage of the circulation compressor at a product pressure and for withdrawal as compressed nitrogen product, wherein the circulation compressor is configured as warm compressor and has a drive that is driven by means of external energy.

Figure 2:
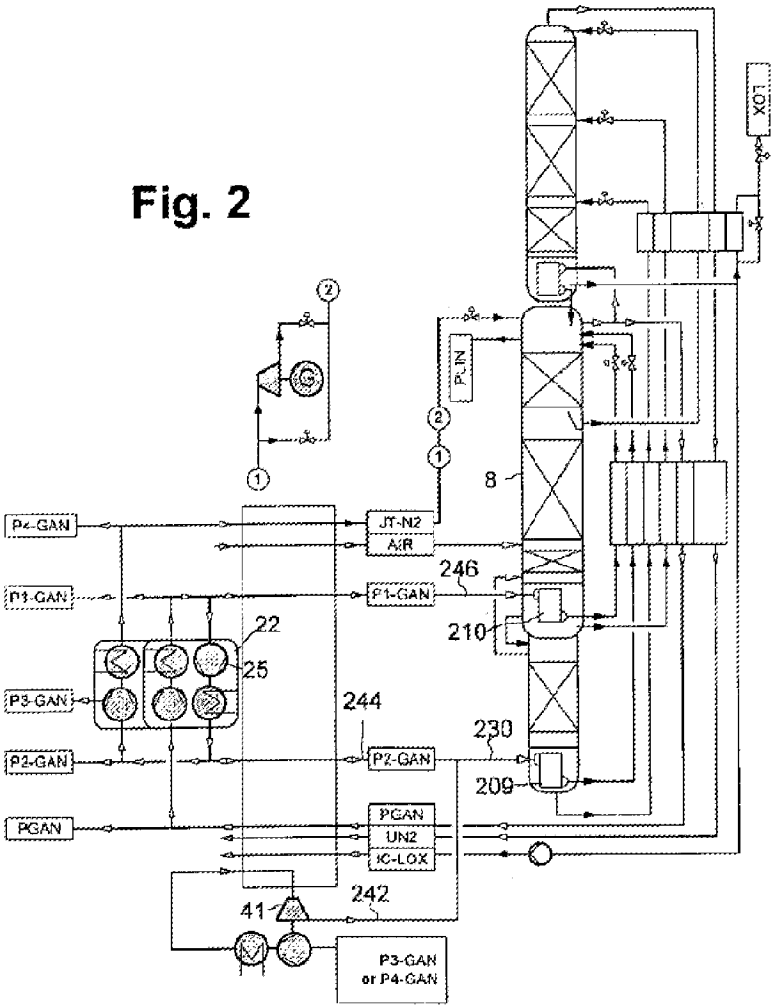
Figure 3:
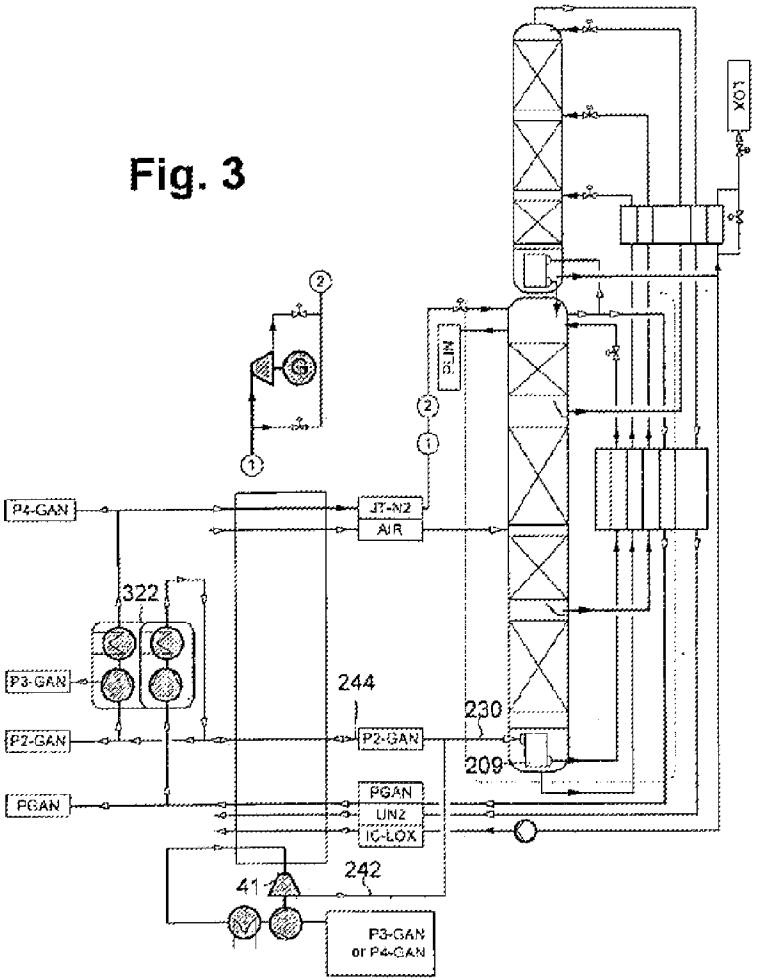
Figure 4:
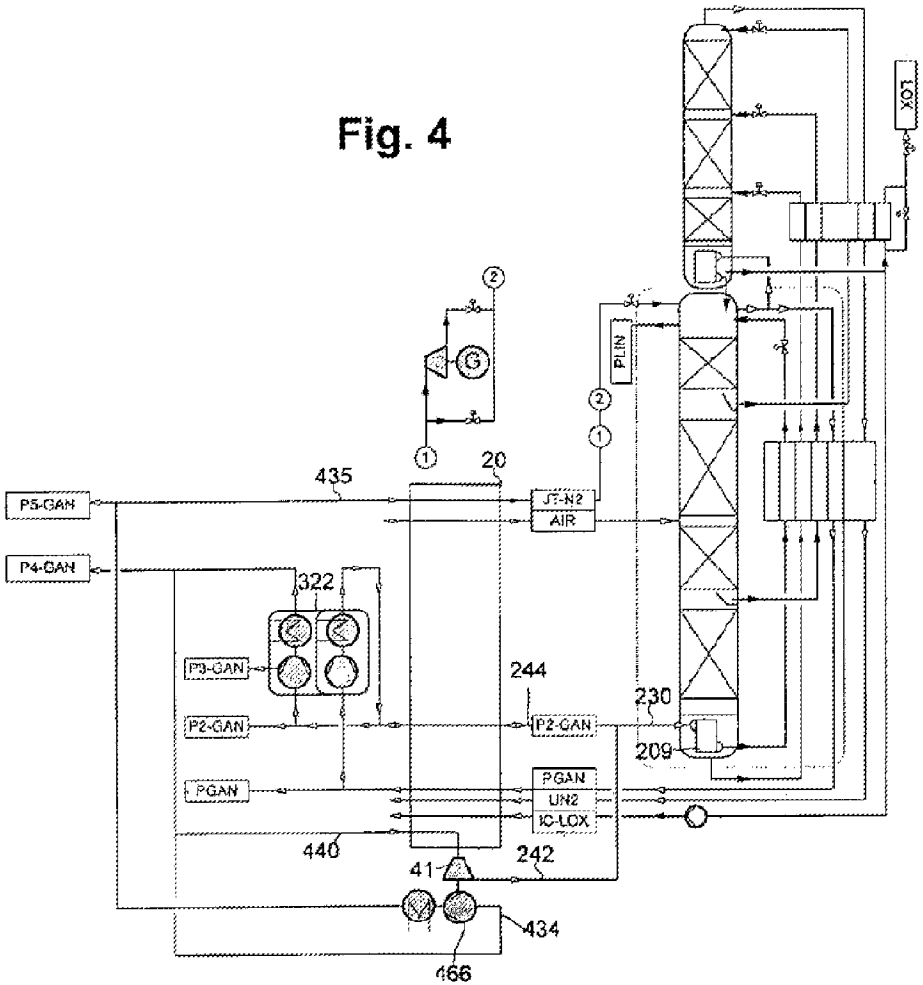
Figure 5:
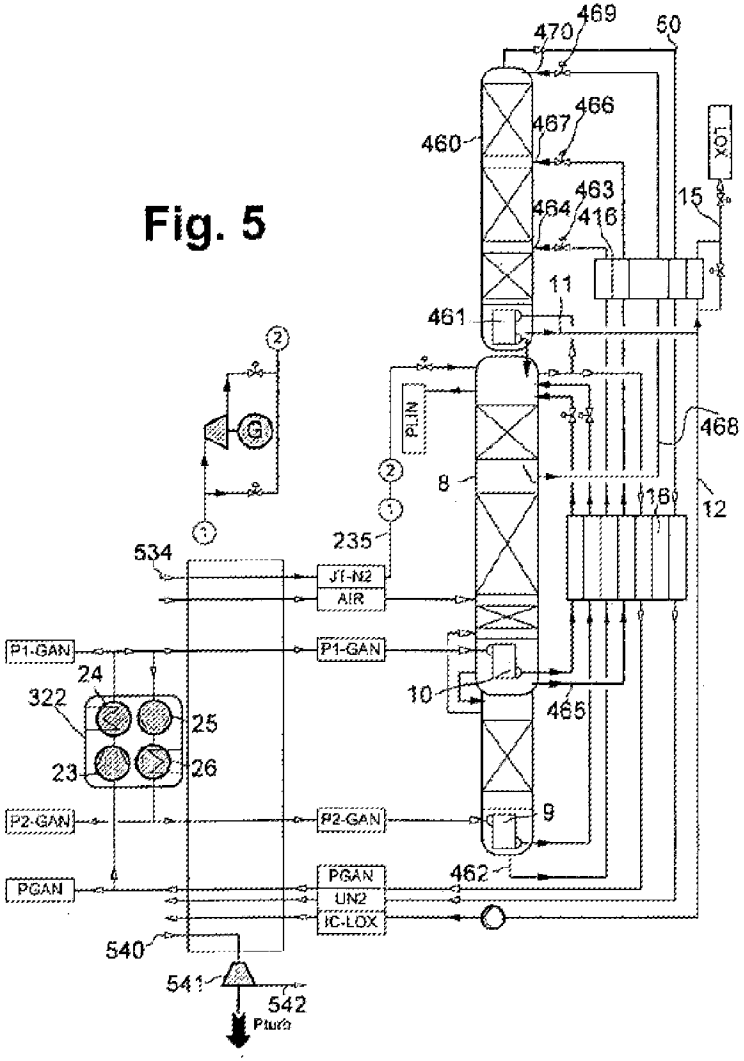
Figure 6:
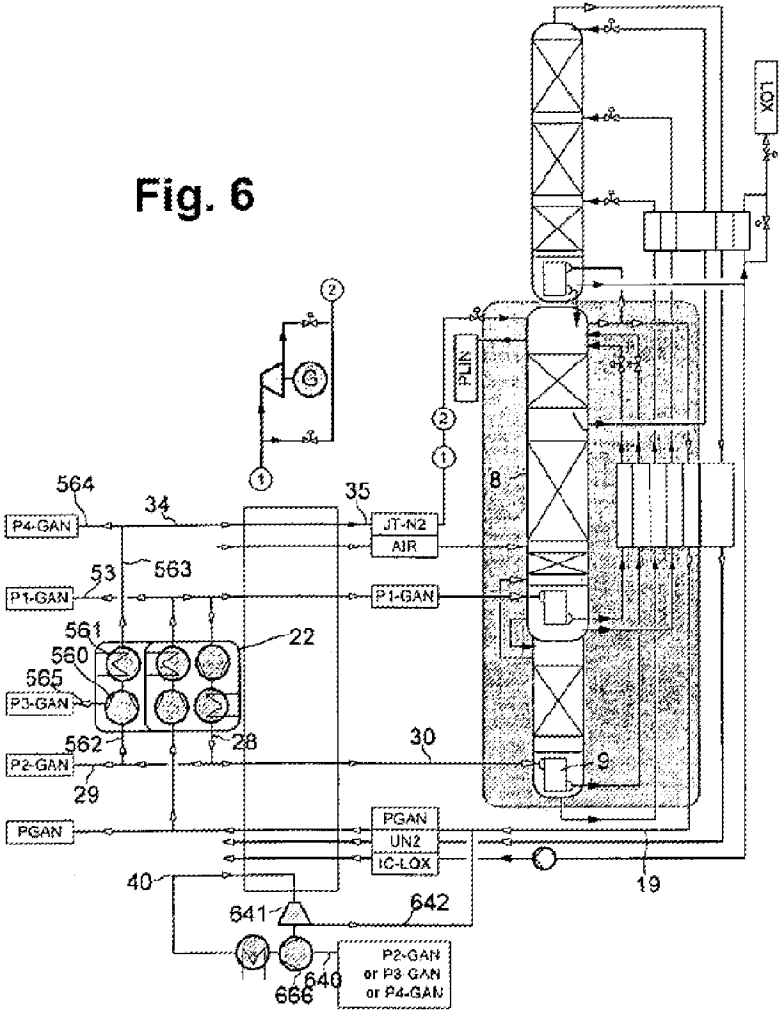
Figure 7:
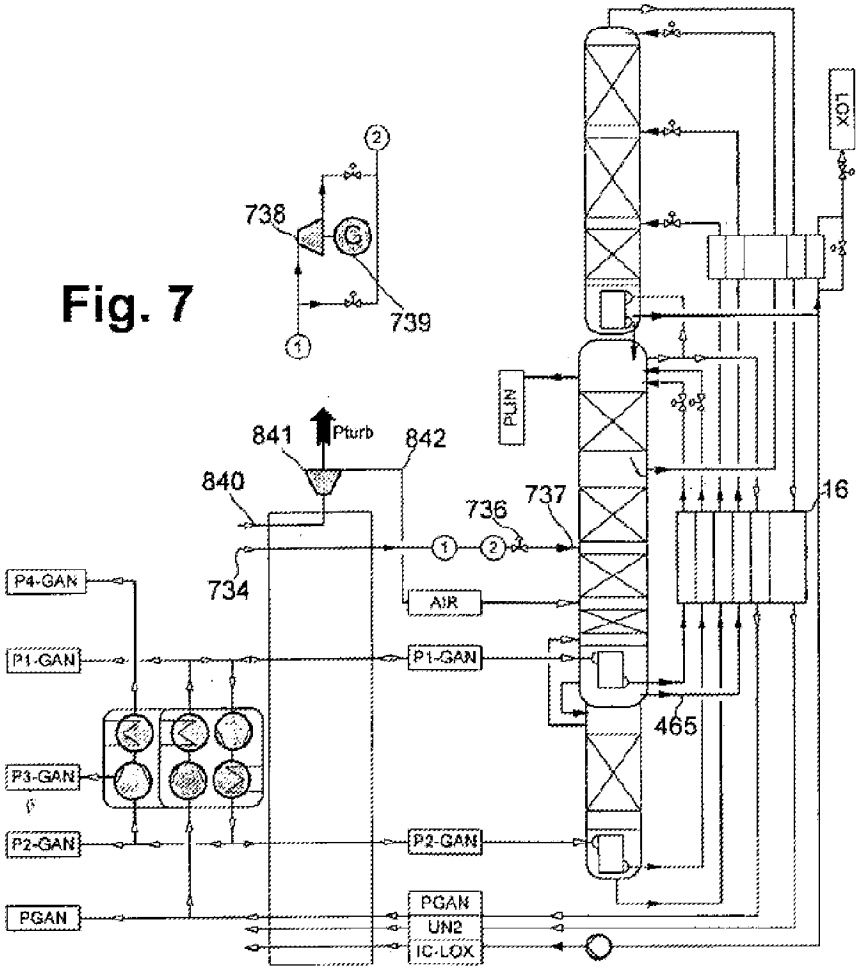
Figure 8:
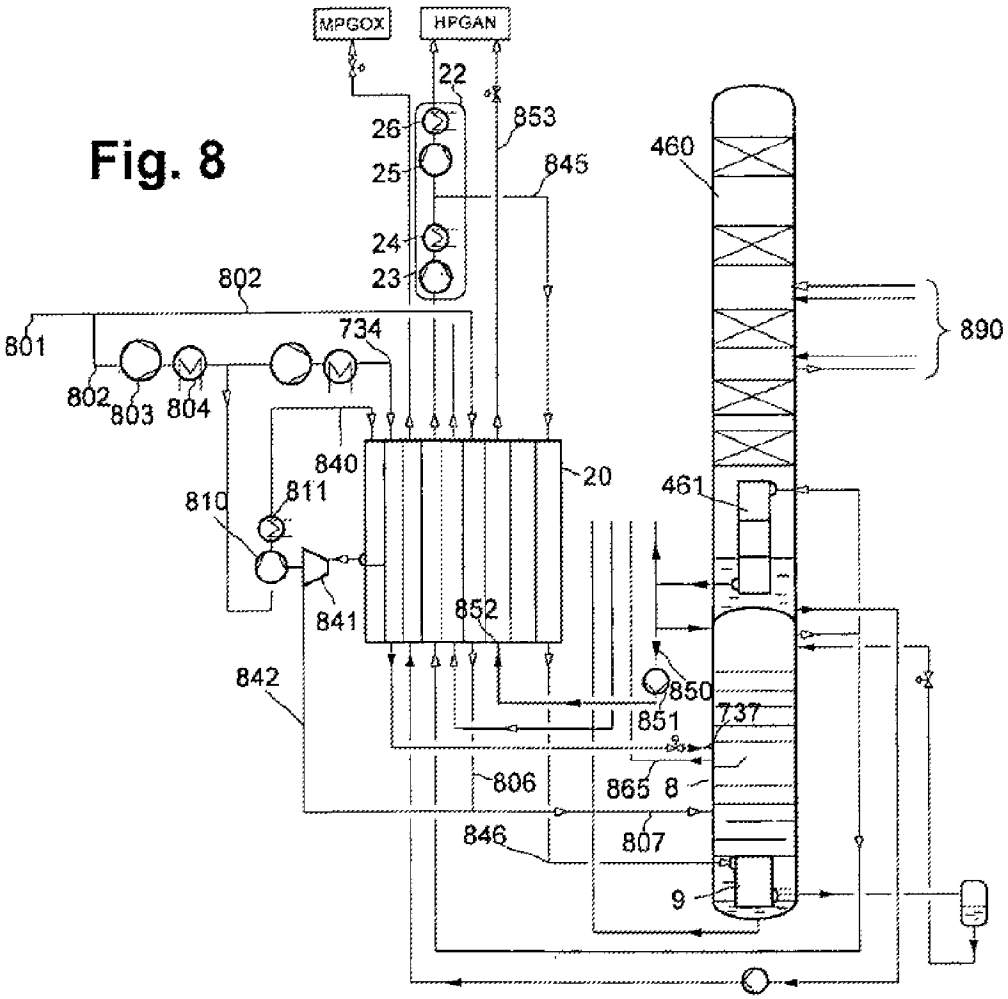
Figure 9:
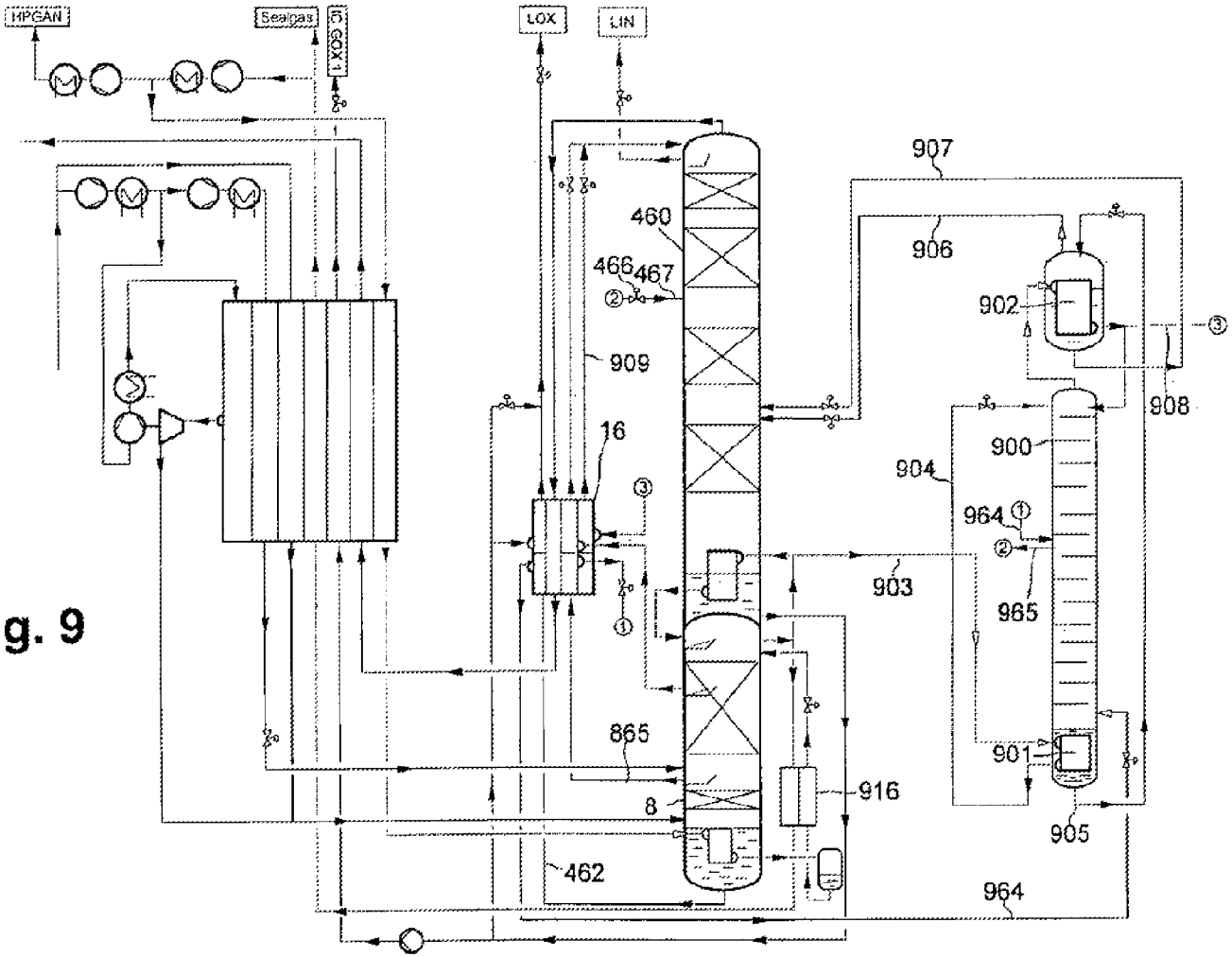

The invention and further details of the invention are explained in more detail below, based on practical examples shown in the drawings, all of which are designed as two-column systems. The drawings show:

FIG. 1 a first practical example of the invention with two condenser-evaporators in the high-pressure column, in which the work-performing expansion leads to the inlet pressure of the second stage of the circulation compressor, FIG. 2 a modification of the first practical example, in which the work-performing expansion leads to the inlet pressure of the second stage of the circulation compressor, FIG. 3 a practical example with only one condenser-evaporator in the high-pressure column and recondensing of the turbine stream, FIG. 4 a modification of this variant with recondensing of the first partial stream of the circulation nitrogen stream, FIGS. 5 to 7 further practical examples with two condenser-evaporators in the high-pressure column and FIGS. 8 and 9 two practical examples with only one condenser-evaporator in the high-pressure column and with one air turbine.

It is not shown in the drawings how atmospheric air is drawn in by an air compressor in a known way via a filter and is compressed to a pressure of approx. 6 bar and is conveyed further via a pre-cooler and a purifier.

In FIG. 1, the compressed and purified feed air 6 is cooled in a main heat exchanger 20 roughly to the dew point and is supplied via line 7 to a distillation-column system for nitrogen-oxygen separation, which in the example consists of a high-pressure column 8 and its assigned column evaporators, a bottom evaporator 9 and an intermediate evaporator 10, and of a low-pressure column 460 and of a main condenser 461, via which the high-pressure column 8 and the low-pressure column 460 are in heat-exchanging communication, wherein the overhead gas of the high-pressure column is brought into indirect heat exchange with the bottom liquid of the. The operating pressure at the top of the low-pressure column 460 is approx. 1.4 bar. The main heat exchanger 20 can be of integrated or split design, FIG. 1 and the other drawings only show the basic function of the exchanger—hot streams are cooled by cold ones.

The bottom liquid 462 ("oxygen-enriched liquid") from the high-pressure column 8 or from the liquefaction side of its bottom evaporator 9 is led completely through a first countercurrent supercooler 16 and a second countercurrent supercooler 415, expanded in a throttle valve 463 to low-pressure-column pressure and supplied via line 464 to the low-pressure column at a first intermediate point. A part 465 of the intermediate liquid of the high-pressure column 8, which arises on the liquefaction side of the intermediate evaporator 10, is drawn off from there, also supercooled in the countercurrent supercoolers 16 and 416 and after throttling 466 is supplied via line 467 to a second intermediate point of the high-pressure column 8, which is located above the first intermediate point. A third feed stream in the form of impure liquid nitrogen 468 is supplied, after supercooling 16/416 and throttling 469, via line 470 to the top of the low-pressure column 460.

The liquid oxygen is in this case taken from the bottom of the low-pressure column 460 or from the liquefaction side of the main condenser 461 and, similarly to stream 11 in FIG. 1, is split into an internal condensing stream ("liquid oxygen stream") 412 and a liquid product (415/417).

In the bottom of the low-pressure column 460, liquid oxygen 11 is produced, which for a first part is brought as "liquid oxygen stream" 12 in a pump 13 of the—depending on product requirements—to a pressure of 6 to 100 bar. The liquid (IC-LOX) is fed at this increased pressure into the main heat exchanger 20, evaporated or pseudo-evaporated in the main heat exchanger and warmed roughly to ambient temperature. Finally the oxygen is obtained as gaseous compressed oxygen product 14.

Another part 15 of the bottom liquid 11 of the low-pressure column 460 is delivered—optionally after supercooling in the countercurrent supercooler 416 via line 17 as liquid oxygen product (LOX).

From the top of the high-pressure column 8, via line 18, nitrogen is extracted as "gaseous circulation nitrogen stream", warmed in the countercurrent supercooler 16 and further (line 19) in the main heat exchanger 20 and finally supplied at least as a first part via line 21 to the first stage 23 of a circulation compressor 22, which in the example has four stages 23, 25, 560 with aftercoolers 24, 16, 561. (The last two compressor stages 560 and aftercooler 561 are shown simplified and can be regarded from the process technology standpoint also as additional product compressor to the circulation compressor 23/25 which is then to be regarded as two-stage, and is driven by an electric motor; as an alternative to 23/25, a circulation compressor in the narrower sense with three or more than four stages can be used.) Another part of the circulation nitrogen stream can be obtained as compressed nitrogen product 27 (PGAN) roughly at the operating pressure of the high-pressure column.

In the first stage 23 of the circulation compressor 22, the circulation nitrogen stream is compressed to a first intermediate pressure (P1-GAN) of approx. 9 bar and in the second stage 25 further to a second intermediate pressure (P2-GAN) of approx. 12 bar. The last two stages 560 compress to a high pressure, which is 1.4 to 2.5 times the oxygen pressure (P4-GAN), or to a third intermediate pressure (P3-GAN). (Further) compressed nitrogen product streams can—as required—be withdrawn from each of these pressure levels (lines 27, 53, 29, 565, 564); together, these compressed nitrogen product streams form a "second partial stream of the circulation nitrogen stream". A part of the circulation nitrogen stream at one of these levels forms a "third partial stream", is re-compressed in an after-compressor 566 to 1.3 to 2 times the pressure and after re-cooling as turbine stream 40 in the main heat exchanger is cooled to an intermediate temperature and finally is expanded with performance of work in an expander 41, which is preferably formed by an expansion turbine. The work-performing expanded turbine stream 42 is used at least as a first part 30 as heating agent in the intermediate evaporator 9 ("first condenser-evaporator") of the high-pressure column 8. In indirect heat exchange with evaporating intermediate liquid of the high-pressure column 8, it is at least partially liquefied. Then this stream is returned, via line 31, through the countercurrent supercooler 16, the throttle valve 32 and finally line 33, into the top of the high-pressure column 8.

For a concrete installation, depending on the cold requirement, one of the pressures P2-GAN to P4-GAN is selected for the stream 540 and corresponding pipework is provided. The mechanical work performed in the expansion turbine 41 is transmitted via mechanical coupling to the after-compressor 566. Alternatively the turbine 41 can be coupled to another compressor, a generator or to a dissipative braking device.

At the top of the high-pressure column 8, liquid nitrogen 43 can be withdrawn as further product stream (PLIN).

At least a part of the circulation nitrogen stream, which was compressed to the final pressure of the circulation compressor 22, forms a "high-pressure process stream", which in the main heat exchanger 20 supplies the heat for the (pseudo-)evaporation of the liquid compressed oxygen. The cold high-pressure process stream 35 is cooled in the countercurrent supercooler 16 (not shown in FIG. 1), expanded in a throttle valve 36 to high-pressure-column pressure and finally delivered via line 37 to the top of the high-pressure column 8. Alternatively, the expansion to high-pressure-column pressure can also be carried out performing work in a liquid turbine 38; in the example shown, the liquid turbine 38 is braked by a generator 39.

From the top of the low-pressure column 460, impure nitrogen 50 is drawn off as residual gas, warmed in the countercurrent supercoolers 416 and 16 and further (line 51, P-UN2) in the main heat exchanger 20 and finally delivered via line 52 as residual product; it can still be used in the process as regenerating gas or as dry gas in an evaporation cooler.

A part 45 of the circulation nitrogen stream downstream of the first stage 23 of the circulation compressor 22 forms a "first partial stream of the circulation nitrogen stream" and—after cooling in the main heat exchanger 20—is at least partially liquefied as intermediate-pressure circulation nitrogen stream 46 in the bottom evaporator 9 of the high-pressure column. Then the intermediate-pressure circulation nitrogen stream is delivered via line 47, the countercurrent supercooler 16, and the throttle valve 48 to the top of the high-pressure column 8.

A line 44, which leads through a passage group of the main heat exchanger 20 ("intermediate passage"), is operated as a reciprocating line in the practical example.

In a first operating mode, a fourth partial stream of the circulation nitrogen stream is withdrawn at a lower intermediate pressure (P1-GAN) from the first intermediate stage of the circulation compressor 22, cooled in the intermediate-pressure passage of the main heat exchanger and via the—in this case with flow toward the right—reciprocating line, mixed with the work-performing expanded turbine stream 42 upstream of the first condenser-evaporator 10. This is especially favorable when relatively little cold is required and therefore the turbine stream is not sufficient for heating the column.

Conversely, in a second operating mode, a part of the work-performing expanded turbine stream in the reciprocating line can be led toward the left, warmed in the intermediate-pressure passage of the main heat exchanger and again supplied to the circulation compressor 22 upstream of the second stage 25.

This is mainly advantageous when a large amount of cold is produced and the turbine stream is therefore too large for heating the first condenser-evaporator.

The method in FIG. 2 differs from that of FIG. 1 in that the work-performing expansion 41 has a higher outlet pressure. This is at a level of approx. 12 bar, which occurs here at the outlet of the second stage 25 of the circulation compressor 22 (P2-GAN). This pressure is sufficient to operate the bottom evaporator 209 of the high-pressure column 8 with the stream 230. The "first partial stream" for thorough heating of the bottom evaporator 209 is thus sometimes identical to the turbine stream, the "third partial stream". The reciprocating line 244 is also at the higher pressure level (P2-GAN). The heating agent used for the intermediate evaporator 210 is in this case a partial stream 246 of the circulation nitrogen stream, which is branched off upstream of the second stage 25 of the circulation compressor 22.

In the practical example in FIG. 3, the high-pressure column has only a single condenser-evaporator, the bottom evaporator 209. Compared to FIG. 2, the intermediate evaporator has been omitted. Therefore the circulation compressor 322 can also have one stage fewer than in FIG. 2.

FIG. 4 shows a modification of FIG. 3. Here, it is not the turbine stream ("third partial stream") 440 that is sent through the after-compressor coupled to the turbine 41, but the "high-pressure process stream" 434, which is then used in the main heat exchanger 20 for (pseudo-)evaporation of the oxygen product. Both the first and the third partial streams originate here from the outlet of the final stage of the circulation compressor 322 (pressure level P4-GAN).

Alternatively, in FIGS. 1 to 3, a generator turbine can also be used instead of the turbine/after-compressor combination 41/566.

In FIG. 5, the circulation compressor 322 is constructed as in FIGS. 3 and 4, wherein it can have just two stages 23, 25. Otherwise the process shown here is more similar to that of FIG. 1, and in particular the high-pressure column 8 has an intermediate evaporator 10.

In the first stage 23 of the circulation compressor 22, the circulation nitrogen stream is compressed to an intermediate pressure of approx. 9 bar and in the second stage 25 further to an upper circulation pressure of up to 16 bar. If the nitrogen, at the upper circulation pressure, is not withdrawn via line 29 as compressed nitrogen product, it serves here exclusively as "first partial stream" for thorough heating of the bottom evaporator 9.

The cold required for the process is produced by work-performing expansion 541 of a turbine stream 540, which is formed by nitrogen in the example, which comes from a nitrogen compressor (for example a separate compressor that is not shown or from an additional stage on the nitrogen circulation compressor). The outlet stream 542 downstream of the work-performing expansion 541 is mixed with one of the nitrogen streams at one of the pressure levels PGAN, P1GAN or P2GAN.

The mechanical work Pturb performed in the expansion turbine 41 is delivered hot, especially to a compressor, a generator or a dissipative brake.

In the example, a nitrogen stream 534, which is at a suitable pressure and comes from a nitrogen compressor (for example a separate compressor that is not shown or from an additional stage on the nitrogen circulation compressor) is used as high-pressure process stream, which, in the main heat exchanger, supplies the heat for the (pseudo-)evaporation of the liquid compressed oxygen. The nitrogen stream 34 can basically also come from any other compressed nitrogen source, and thus the pressure levels PGAN, P1-GAN or P2-GAN. It can be expanded to any suitable existing pressure level PGAN or P1-GAN and can then be added to the corresponding circulation or compressed-product stream. Alternatively the work-performing expansion leads to atmospheric level and the expanded turbine stream is finally delivered without pressure, after warming in the main heat exchanger.

The cold high-pressure process stream 535 is conveyed as in FIG. 1.

The method in FIG. 6 differs from that in FIG. 1 in that the outlet pressure of the work-performing expansion 641 (line 642) is at the level PGAN of the operating pressure of the high-pressure column 8. As a result, correspondingly more cold can be obtained for product liquefaction.

The turbine stream 540 is formed by at least one part of one of the following three streams:

29 (P2-GAN) from the final stage of the circulation compressor 28

565 (P3-GAN) from an intermediate stage of the product compressor 560

564 (P4-GAN) from the final stage of the product compressor 560

The turbine stream is expanded, performing work, roughly to the operating pressure of the pressure column 8. The expanded turbine stream 642 is finally mixed with the circulation nitrogen stream 19, which comes from the top of the pressure column 8. The turbine power is in this case delivered to a nitrogen after-compressor 666, which further increases the pressure of the turbine stream.

In the process in FIG. 7, the high-pressure process stream 734 is not formed by nitrogen but by a partial stream of the feed air. This can for example be branched off downstream of a purifier, which is not shown, and brought in an after-compressor up to the required pressure, which can be up to 90 bar. (Main air compressor, purifier, branching and after-compressor are not shown in FIG. 7.) Similarly to FIGS. 1 to 6, the high-pressure process stream 734 is cooled and (pseudo-)liquefied in the main heat exchanger, expanded in the throttle valve 736 to high-pressure-column pressure and finally fed via line 737 at a suitable intermediate point into the high-pressure column 8. Also similarly to FIGS. 1 to 6, the expansion to pressure-column pressure can also be effected performing work in a liquid turbine 738, which is preferably braked by a generator 739. The use of air as high-pressure process stream shown in FIG. 7 can also be applied to the process variants in FIGS. 1 to 6.

The turbine stream 840 for the work-performing expansion 841 in FIG. 7 is not formed by nitrogen, but by another part of the feed air, here especially the remainder of the feed air that is not used as high-pressure process stream 734. As a result, all of the air in the air compressor is compressed to a pressure well above high-pressure-column pressure of up to 90 bar and then split into the turbine stream 840 and the high-pressure process stream 734. (Alternatively the turbine stream 840 and/or the high-pressure process stream can be further compressed separately.) The expanded turbine stream is fed at a suitable intermediate point into the high-pressure column 8.

The second modification shown in FIG. 7 (air turbine instead of nitrogen turbine) can also be in the methods in FIGS. 1 to 6), alone or in combination with the use of air as high-pressure process stream.

The method in FIG. 8 also uses feed air as high-pressure process stream 734 and as turbine stream 840. All of the air is compressed in a main air compressor roughly to high-pressure-column pressure and then purified in a purifier (neither is shown in the drawing). The air 801 compressed to high-pressure-column pressure and purified is split into a total of three partial streams, the high-pressure process stream 734, the turbine stream 840 and in addition a direct air stream 802, 806, which is fed without further pressure-altering measures via line 807 in gaseous form into the high-pressure column 8. The high-pressure process stream and the turbine stream are led jointly via line 802 to a first externally driven after-compressor 803 with aftercooler 804 and then branched further. The high-pressure process stream is further compressed in another externally driven after-compressor 808 with aftercooler 809 to an especially high pressure, whereas the turbine stream flows through an after-compressor 810, which is driven by the expander 841, which is formed by a turboexpander and is coupled mechanically via a common shaft to the after-compressor 810. The after-compressor 810 also has an aftercooler 811.

A part 865 of the air fed in liquid form via line 737 into the high-pressure column 8 is again taken from the high-pressure column and similarly to stream 465 in FIG. 1 is supplied at an intermediate point to the low-pressure column 460.

The "first partial stream" of the circulation nitrogen stream is formed here by the stream 845/846, which is taken between the two stages 23, 25 of the circulation compressor 22 and is sent to the bottom evaporator 9 of the high-pressure column 8.

The low-pressure column 460 is connected to a conventional argon production system via the pipelines. The details of argon production with raw argon column are not shown here, being familiar to a person skilled in the art.

In an alternative, in FIG. 8, instead of stream 845, another compressed nitrogen stream is used as heating medium for the bottom evaporator 9 of the high-pressure column 8. Moreover, an additional compressed nitrogen product stream 853 is obtained by internal condensing, in which a part 850 of the liquid nitrogen obtained in the main condenser 461 is brought in a pump 851 in liquid form to a high pressure, and led via line 852 to the main heat exchanger 20, where it is evaporated or pseudo-evaporated and warmed to ambient temperature.

FIG. 9 largely corresponds to FIG. 8, but does not have nitrogen internal condensing. The countercurrent supercoolers, not shown in FIG. 8, are shown here. The method differs by an additional medium-pressure column 900, which is operated at an operating pressure that is between the operating pressures of low-pressure column 760 and high-pressure column 8. The bottom liquid 462 ("oxygen-enriched liquid") from the high-pressure column 8 or from the liquefaction side of its bottom evaporator 9 is in this case not fed directly, but indirectly to the low-pressure column 460. After supercooling 16 it goes first via line 964 to the medium-pressure column 900 and there undergoes further preliminary separation. In contrast to the previous practical examples, the liquid air 865 is in this case also not fed to the low-pressure column 460, but after flowing through the countercurrent supercooler 16 and a throttle valve is fed via line 965 at an intermediate point to the medium-pressure column 900. (A part can be taken again via line 965 and as in FIG. 1 can be fed via 466 and 467 into the low-pressure column 460.)

The medium-pressure column 900 has two condenser-evaporators, a medium-pressure column bottom evaporator 901 and a medium-pressure column head condenser 902. The medium-pressure column bottom evaporator 901 is heated by means of a partial stream 903 of the overhead nitrogen of the high-pressure column 8. The resultant condensed nitrogen 904 is delivered as return liquid to the top of the medium-pressure column 900. The medium-pressure column head condenser 902 is cooled with the bottom liquid 905 of the medium-pressure column 900 or by the liquefaction side of its bottom evaporator 901. The resultant steam 906 and the fraction 907 remaining liquid are fed into the low-pressure column 460. The part 908 of the liquid nitrogen obtained in the medium-pressure column head condenser 902, which is not fed as return liquid into the medium-pressure column 900, can be used after supercooling 16 as additional return liquid 909 for the low-pressure column 460.

The invention claimed is:

1. A method of obtaining compressed oxygen and compressed nitrogen by separation of air in a distillation-column system for nitrogen-oxygen separation, said distillation-column system having at least one high-pressure column (8) with bottom evaporator (9, 209) and a low-pressure column (460), wherein the low-pressure column (460) is in heat-exchanging communication with the high-pressure column (8) via a main condenser (461), configured as a condenser-evaporator, said high-pressure column (8) having a top and a bottom, and said low-pressure column (460) having a top and a bottom, said method comprising:

compressing feed air in an air compressor (2), cooling the compressed feed air (6, 734, 802, 840) in a main heat exchanger (20), and feeding the cooled and compressed feed air at least partially into said high-pressure column (8), removing an oxygen-enriched liquid (462, 465) from the high-pressure column (8), and supplying the oxygen-enriched liquid to said low-pressure column (460) at a first point (464, 467, 906) intermediate to said top and bottom of low-pressure column (460), removing a nitrogen-enriched liquid (468, 470) from said high-pressure column (8) and/or said main condenser (461), and delivering the nitrogen-enriched liquid to the top of said low-pressure column (460), removing an oxygen stream (11, 12) in the liquid state from said distillation-column system for nitrogen-oxygen separation, pressurizing the oxygen stream in the liquid state to an increased pressure (13), feeding the oxygen stream at the increased pressure into said main heat exchanger (20) wherein the oxygen stream is evaporated or pseudo-evaporated and warmed to form a gaseous compressed oxygen product (14), and removing the gaseous compressed oxygen product (14) from said main heat exchanger (20), bringing a pressurized process stream (34, 734) into indirect heat exchange with the oxygen stream in the main heat exchanger (20) wherein the pressurized process stream is cooled and the oxygen stream is evaporated or pseudo-evaporated and warmed , expanding the cooled pressurized process stream (36, 38; 736, 738) to form an expanded process stream, and then feeding the expanded process stream (37, 737), at least partially in the liquid state, into said distillation-column system for nitrogen-oxygen separation, withdrawing a gaseous circulation nitrogen stream (18, 19) from said high-pressure column and compressing at least a portion (21) of the gaseous circulation nitrogen stream in a circulation compressor (22), wherein said circulation compressor (22, 322) is a multistage compressor, withdrawing a first partial stream (45, 46; 244, 242, 230; 845, 846) of the gaseous circulation nitrogen stream from the circulation compressor (22, 322), cooling the first partial stream in said main heat exchanger (20), at least partially liquefying the first partial stream in said bottom evaporator (9, 209) of said high-pressure column (8) by indirect heat exchange with bottom liquid of said high-pressure column (8), and recycling the first partial stream to said distillation-column system for nitrogen-oxygen separation, branching off a second partial stream of the gaseous circulation nitrogen stream upstream and/or downstream of said circulation compressor and/or of an intermediate stage of said circulation compressor at a product pressure (P, P1, P2, P3, P4) as compressed nitrogen product (27, 29, 53, 564, 565), wherein said circulation compressor (22, 322) operates with an inlet temperature that is above 250 K and is driven by means of external energy, wherein a third partial stream of the gaseous circulation nitrogen stream is withdrawn from said circulation compressor (22, 322) as a turbine stream (40; 242), expanded with performance of work (41), and fed at least partially into said distillation-column system for nitrogen-oxygen separation, and wherein in a first operating mode a fourth partial stream (45) of the gaseous circulation nitrogen stream is withdrawn from an intermediate stage of said circulation compressor at a pressure (P1-GAN, P2-GAN) which is lower than the pressure at which said third partial stream is withdrawn from said circulation compressor (22, 322), cooled in a passage of the main heat exchanger, and mixed with the expanded turbine stream (42), resulting from the expansion of the third partial stream, upstream of said bottom evaporator (9) and the resultant combined stream (30) is recycled to said the distillation-column system for nitrogen-oxygen separation.

2. The method as claimed in claim 1, wherein a total amount of compressed nitrogen product (PN) is obtained, said total amount of compressed nitrogen product being formed by the sum of all streams that are branched from the circulation nitrogen stream upstream and/or downstream of the circulation compressor and/or of an intermediate stage of the circulation compressor at a product pressure (P, P1, P2, P3, P4) removed as compressed nitrogen product (27, 29, 53, 564, 565), wherein in a first loading case a first total amount of compressed nitrogen product PN1 is obtained, the first partial stream is fed at a first amount TS1 through the bottom evaporator (9, 209) of the high-pressure column (8) and the feed air is fed at a first amount EL1 into the air compressor (2), and wherein in a second loading case a second, higher total amount of compressed nitrogen product PN2 is obtained, wherein PN2>PN1, the first partial stream is fed at a second amount TS2 through the bottom evaporator (9, 209) of the high-pressure column (8), wherein TS2>TS1, and the feed air is fed at a second amount EL2 into the air compressor (2), wherein the first amount of feed air EL1, the second amount of feed air EL2, the first total amount of compressed nitrogen product PN1, and the second total amount of compressed nitrogen product PN2 satisfy the following equation $(EL2-EL1)/EL1<0.2\cdot(PN2-PN1)/PN1$.

3. The method as claimed in claim 1, wherein a liquid fraction from an intermediate point of the high-pressure column (8) is fed at the operating pressure of the high-pressure column into an intermediate condenser-evaporator (10) of the high-pressure column, and there, in indirect heat exchange with at least one part of the work-performing expanded turbine stream, is evaporated at least partially, and the stream resulting from the at least partial evaporation of said liquid fraction is recycled at least partially to the high-pressure column (8).

4. The method as claimed in claim 1, wherein said third partial stream of the circulation nitrogen stream is withdrawn from an intermediate stage of the circulation compressor and then supplied to the work-performing expansion.

5. The method as claimed in claim 4, wherein a partial stream of the gaseous circulation nitrogen stream is withdrawn from the circulation compressor at a pressure which is higher than the pressure at which said third partial stream is withdrawn from said circulation compressor, and is then used as said pressurized process stream (34).

6. The method as claimed in claim 1, wherein in a second operating mode a part of the work-performing expanded turbine stream (42) is warmed in the main heat exchanger and is supplied to the circulation compressor at an intermediate stage thereof.

7. The method as claimed in claim 1, wherein said oxygen stream (411, 412) is withdrawn from a lower region of the low-pressure column (460).

8. The method as claimed in claim 1, wherein a liquid stream (465, 467), whose oxygen content is between that of the oxygen-enriched liquid (462) and that of the nitrogen-enriched liquid (468), is withdrawn from the high-pressure column (8) and supplied to the low-pressure column (460) at a second point (467), which is arranged above said first point (464).

9. A device for obtaining compressed oxygen and compressed nitrogen by separation of air with a distillation-column system for nitrogen-oxygen separation comprising a high-pressure column (8) and a low-pressure column (460), said high-pressure column (8) having a top and a bottom, and said low-pressure column (460) having a top and a bottom, wherein the low-pressure column (460) has a main condenser (461), configured as condenser-evaporator, which provides a heat-exchanging connection between said low-pressure column (460) and said high-pressure column (8), an air compressor (2) for compressing feed air, a main heat exchanger (20) for cooling the compressed feed air (6, 734, 802, 840), a line (7) for feeding cooled feed air into the high-pressure column (8), a line for withdrawing an oxygen-enriched liquid (462, 465) from the high-pressure column (8) and for supplying the oxygen-enriched liquid (464, 467), or a liquid derived therefrom (467, 906), to the low-pressure column (460) at a first point intermediate to said top and bottom of the low-pressure column, a line for withdrawing a nitrogen-enriched liquid (468, 470) from the high-pressure column (8) and/or the main condenser (461) and for delivering the nitrogen-enriched liquid to the top of the low-pressure column (460), a line for withdrawing an oxygen stream in the liquid state (11, 12, 411, 412) from the distillation-column system for nitrogen-oxygen separation, means for bringing the oxygen stream in the liquid state to an increased pressure (13), a line for feeding the oxygen stream at the increased pressure into the main heat exchanger (20) wherein the oxygen stream is evaporated or pseudo-evaporated and warmed, and a line for withdrawing the oxygen stream from said main heat exchanger as gaseous compressed oxygen product (14), a line for feeding a pressurized process stream (34, 734) into said main heat exchanger (20), wherein said pressurized process stream undergoes indirect heat exchange with the oxygen stream in which the pressurized process stream is cooled and the oxygen stream is evaporated or pseudo-evaporated and warmed, a line for withdrawing the cooled pressurized process stream from said main heat exchanger (20), and means for expanding the withdrawn, cooled, pressurized process stream (36, 38, 736, 738) to form an expanded process stream, a line (37, 737) for feeding the expanded process stream at least partially in the liquid state into the distillation-column system for nitrogen-oxygen separation, a line (8, 19) for withdrawing a gaseous circulation nitrogen stream from the high-pressure column, a circulation compressor (22, 322) for compressing at least a portion (21) of the gaseous circulation nitrogen stream, a line for withdrawing a first partial stream (45, 46; 244, 242, 230; 845, 846) of the gaseous circulation nitrogen stream from the circulation compressor (22, 322) and introducing the first partial stream into the main heat exchanger (20) where the first partial stream undergoes cooling, a line for feeding the first partial stream from the main heat exchanger into the bottom evaporator (9) of the high-pressure column (8) wherein the first partial stream undergoes at least partial liquefaction in indirect heat exchange with the bottom liquid of the high-pressure column (8), and a line for recycling the at least partially liquefied first partial stream to the distillation-column system for nitrogen-oxygen separation, and a line for branching off a second partial stream of the gaseous circulation nitrogen stream upstream and/or downstream of the circulation compressor and/or from an intermediate stage of the circulation compressor at a product pressure (P, P1, P2, P3, P4) and for withdrawing the second partial stream as compressed nitrogen product (27, 29, 53, 564, 565), wherein said circulation compressor (22, 322) is configured to operate with an inlet temperature that is above 250 K and has a drive that is driven by means of external energy.

10. The device as claimed in claim 9, further comprising controlling means for controlling the amount of compressed nitrogen product (PN), formed by the sum of the flows, which are branched off upstream and/or downstream of the circulation compressor and/or from an intermediate stage of the circulation compressor at a product pressure (P, P1, P2, P3, P4) from the gaseous circulation nitrogen stream, which is obtained as compressed nitrogen product (27, 29, 53, 564, 565), the flow (TS) of the first partial stream fed to the bottom evaporator (9, 209) of the high-pressure column (8), and the flow of feed air (EL) is fed into the high-pressure column (8), and wherein the controlling means are configured so that in a first loading case a first amount of compressed nitrogen product PN1 is obtained, the first partial stream is fed at a first partial stream flow rate TS1 through the bottom evaporator (9, 209) of the high-pressure column (8), and the feed air is fed is at a first feed air flow rate EL1 into the high-pressure column (8), and in a second loading case a second amount of compressed nitrogen product PN2 is obtained, wherein PN2>PN1, the first partial stream is fed at a second partial stream flow TS2 through the bottom evaporator (9, 209) of the high-pressure column (8), wherein TS2>TS1, and the feed air is fed at a second feed air flow rate EL2 into the high-pressure column (8), wherein the first and second feed air flow rate and the first and second amounts of compressed nitrogen product satisfy the following equation: $EL1<EL2<EL1\cdot 0.2\cdot PN2/PN1$.

11. The device as claimed in claim 10, further comprising a line for withdrawing from the high-pressure column (8) a liquid (465, 467) stream whose oxygen content is between that of the oxygen-enriched liquid (462) and that of the nitrogen-enriched liquid (468), and a line for supplying said liquid stream to the low-pressure column (460) at a second point, which is arranged above said first point.

12. The method as claimed in claim 8, wherein said the high-pressure column (8) has an intermediate evaporator (10) positioned at a point intermediate to said top and said bottom of said the high-pressure column (8), and said liquid stream (465, 467) having an oxygen content between that of the oxygen-enriched liquid (462) and that of the nitrogen-enriched liquid is withdrawn from the high-pressure column (8) at the level of said intermediate evaporator (10).

13. The device as claimed in claim 11, wherein said the high-pressure column (8) has an intermediate evaporator (10) positioned at a point intermediate to said top and said bottom of said the high-pressure column (8), and said liquid stream (465, 467) having an oxygen content between that of the oxygen-enriched liquid (462) and that of the nitrogen-enriched liquid is withdrawn from the high-pressure column (8) at the level of said intermediate evaporator (10).

14. The method as claimed in claim 1, wherein said expanded process stream, at least partially in the liquid state, is fed into the top of said high-pressure column.

15. The method as claimed in claim 1, wherein said third partial stream of the gaseous circulation nitrogen stream is withdrawn from an intermediate stage of said circulation compressor.

16. A method of obtaining compressed oxygen and compressed nitrogen by separation of air in a distillation-column system for nitrogen-oxygen separation, said distillation-column system having at least one high-pressure column (8) with bottom evaporator (9, 209) and a low-pressure column (460), wherein the low-pressure column (460) is in heat-exchanging communication with the high-pressure column (8) via a main condenser (461), configured as a condenser-evaporator, said high-pressure column (8) having a top and a bottom, and said low-pressure column (460) having a top and a bottom said method comprising:

compressing feed air in an air compressor (2), cooling the compressed feed air (6, 734, 802, 840) in a main heat exchanger (20), and feeding the cooled and compressed feed air at least partially into said high-pressure column (8), removing an oxygen-enriched liquid (462, 465) from the high-pressure column (8), and supplying the oxygen-enriched liquid to said low-pressure column (460) at a first point (464, 467, 906) intermediate to said top and bottom of low-pressure column (460), removing a nitrogen-enriched liquid (468, 470) from said high-pressure column (8) and/or said main condenser (461), and delivering the nitrogen-enriched liquid to the top of said low-pressure column (460), removing an oxygen stream (11, 12) in the liquid state from said distillation-column system for nitrogen-oxygen separation, pressurizing the oxygen stream in the liquid state to an increased pressure (13), feeding the oxygen stream at the increased pressure into said main heat exchanger (20) wherein the oxygen stream is evaporated or pseudo-evaporated and warmed to form a gaseous compressed oxygen product (14), removing the gaseous compressed oxygen product (14) from said main heat exchanger (20), bringing a pressurized process stream (34, 734) into indirect heat exchange with the oxygen stream in the main heat exchanger (20) wherein the pressurized process stream is cooled and the oxygen stream is evaporated or pseudo-evaporated and warmed, expanding the cooled pressurized process stream (36, 38; 736, 738) to form an expanded process stream, and then feeding the expanded process stream (37, 737), at least partially in the liquid state, into said distillation-column system for nitrogen-oxygen separation, withdrawing a gaseous circulation nitrogen stream (18, 19) from said high-pressure column and compressing at least a portion (21) of the gaseous circulation nitrogen stream in a circulation compressor (22), wherein said circulation compressor (22, 322) is a multistage compressor, withdrawing a first partial stream (45, 46; 244, 242, 230; 845, 846) of the gaseous circulation nitrogen stream from the circulation compressor (22, 322), cooling the first partial stream in said main heat exchanger (20), at least partially liquefying the first partial stream in said bottom evaporator (9, 209) of said high-pressure column (8) by indirect heat exchange with bottom liquid of said high-pressure column (8), and recycling the first partial stream to said distillation-column system for nitrogen-oxygen separation, branching off a second partial stream of the gaseous circulation nitrogen stream upstream and/or downstream of said circulation compressor and/or of an intermediate stage of said circulation compressor at a product pressure (P, P1, P2, P3, P4) as compressed nitrogen product (27, 29, 53, 564, 565), wherein said circulation compressor (22, 322) operates with an inlet temperature that is above 250 K and is driven by means of external energy, wherein a third partial stream of the gaseous circulation nitrogen stream is withdrawn from said circulation compressor (22, 322) as a turbine stream (40; 242), expanded with performance of work (41), and fed at least partially into said distillation-column system for nitrogen-oxygen separation, and wherein in a first operating mode a fourth partial stream (45) of the gaseous circulation nitrogen stream is withdrawn from an intermediate stage of said circulation compressor at a pressure (P1-GAN, P2-GAN) which is lower than the pressure at which said third partial stream is withdrawn from said circulation compressor (22, 322), cooled in a passage of the main heat exchanger, and mixed with the expanded turbine stream (42), resulting from the expansion of the third partial stream, upstream of said bottom evaporator (9) and the resultant combined stream (30) is recycled to said the distillation-column system for nitrogen-oxygen separation, and wherein in a second operating mode a part of the third partial stream of the gaseous circulation nitrogen stream that is not fed into said distillation-column system for nitrogen-oxygen separation is warmed in in a passage of said main heat exchanger and supplied to the circulation compressor at an intermediate stage thereof.

17. The method as claimed in claim 16, wherein the passage in the main heat exchanger that is used in the first operating mode for cooling the fourth partial stream is the same passage used in second operating mode for warming the part of the third partial stream of the gaseous circulation nitrogen stream.

* * * * *